US009186039B2

(12) United States Patent
Pipp

(10) Patent No.: US 9,186,039 B2
(45) Date of Patent: Nov. 17, 2015

(54) BASKET OF DISHWASHER FOR WASHING COMPONENTS OF BABY BOTTLE

(71) Applicant: Walter Pipp, Troy, MI (US)

(72) Inventor: Walter Pipp, Troy, MI (US)

( * ) Notice: Subject to any disclaimer, the term of this patent is extended or adjusted under 35 U.S.C. 154(b) by 0 days.

(21) Appl. No.: 14/212,240

(22) Filed: Mar. 14, 2014

(65) Prior Publication Data

US 2014/0263302 A1 Sep. 18, 2014

Related U.S. Application Data

(60) Provisional application No. 61/782,293, filed on Mar. 14, 2013.

(51) Int. Cl.

| | |
|---|---|
| ***A47L 15/50*** | (2006.01) |
| ***B07B 11/02*** | (2006.01) |
| *B65D 21/02* | (2006.01) |
| *B65D 25/10* | (2006.01) |

(52) U.S. Cl.

CPC ..... *A47L 15/505* (2013.01); *B07B 11/02* (2013.01); *A47L 15/501* (2013.01); *B65D 21/0212* (2013.01); *B65D 25/107* (2013.01)

(58) Field of Classification Search

CPC ..... A47L 15/505
USPC ..... 211/41.8, 41.9; 220/487, 488; 248/102, 248/107

See application file for complete search history.

(56) References Cited

U.S. PATENT DOCUMENTS

| | | | | | |
|---|---|---|---|---|---|
| D165,610 | S | * | 1/1952 | Sandberg | D32/55 |
| 4,058,233 | A | * | 11/1977 | Frangos | 220/488 |
| 4,192,432 | A | * | 3/1980 | Jordan | 220/676 |
| 4,498,594 | A | * | 2/1985 | Elder | 211/41.9 |
| 4,830,200 | A | * | 5/1989 | Zambano et al. | 211/133.5 |
| 6,814,091 | B2 | * | 11/2004 | McConnell et al. | 134/135 |
| 7,918,361 | B2 | * | 4/2011 | Geis | 220/488 |
| D703,882 | S | * | 4/2014 | Williams et al. | D32/3 |
| 2005/0087453 | A1 | * | 4/2005 | Mahieu et al. | 206/5.1 |
| 2006/0065666 | A1 | * | 3/2006 | Dunn et al. | 220/676 |
| 2007/0261724 | A1 | * | 11/2007 | Kemper et al. | 134/84 |
| 2010/0300997 | A1 | * | 12/2010 | Bramley et al. | 211/74 |
| 2014/0014605 | A1 | * | 1/2014 | Kilgore et al. | 211/85.25 |

* cited by examiner

*Primary Examiner* — Anthony Stashick
*Assistant Examiner* — Mollie Llewellyn

(57) ABSTRACT

A dishwasher basket washes a cap, ring, and nipple (collectively, "the components") of a baby bottle. A body holds the ring and nipple in position in non-contacting relationship with each other and a dishwasher and includes a restraint extending from an interior side wall of the body into an interior thereof and retaining the ring above a part of the nipple while allowing a remainder of the nipple to pass by the ring. A cover is disposed directly above and spaced from the body for holding the cap in position relative to the ring, nipple, and dishwasher and covering entirely the components and a remainder of the basket. A grid is disposed between the body and cover for spacing the nipple and ring from the cap and movable out of the way such that a vertical path defined by alignment of the components is clear for reassembly thereof.

16 Claims, 5 Drawing Sheets

BASKET OF DISHWASHER FOR WASHING COMPONENTS OF BABY BOTTLE

CROSS-REFERENCE TO RELATED APPLICATION

This application is based upon and claims benefit of the filing date of U.S. Provisional Patent Application 61/782,293 filed on Mar. 14, 2013, entitled "Basket of Dishwasher for Washing Components of Baby Bottle," and incorporated herein by reference in its entirety.

BACKGROUND OF INVENTION

1. Field of Invention

The invention relates, generally, to a basket of a dishwasher and, more particularly, to such a basket for washing components of a baby bottle.

2. Description of Related Art

A baby bottle includes generally, among other structure, a cap, ring, and nipple (hereinafter referred to collectively as "the components"). Such bottles can differ relative to each other with respect to shape, size, and structure. As such, each of the components of a particular bottle can come in various shapes, sizes, and structures. A dishwasher is typically used to wash the bottle, including each of the components. In turn, the dishwasher includes generally, among other structure, at least one basket and at least one rack. Unfortunately, there are several disadvantages to dishwasher baskets known in the related art when they are used to wash the components.

To elaborate, with a known dishwasher basket, as related specifically to the washing of the bottle in the dishwasher, the components are not held in position relative to the basket and/or each other. As a result, water—which is not clear of, for example, dirt and/or soap—can become trapped in each of the components.

With another known dishwasher basket, the nipples protrude from or stick out of a top of the basket and, thus, are highly exposed to contaminants and germs (i.e., food and/or dirty liquids, for instance, may splash on the nipples or people may touch them during handling and storage of the basket). (The nipples are later exposed to potential contact with storage compartments of kitchens and nurseries, too.) Also, as related specifically to loading and unloading of the basket, the action of opening a lid of the basket on a countertop causes the nipples that are now loosely held in the lid to fall out of their respective positions in the basket, making reclosing of the basket difficult or impossible.

With another known dishwasher basket, the components are placed or stacked on respective pegs or posts of the basket to hold the components in position relative to the basket and/or each other. However, in this way, the components are not all aligned with each other such that they cannot be easily and quickly reassembled with each other after completion of the washing. More specifically, this basket requires extensive handling of the components to reassemble them with each other—and a larger space in the dishwasher for it to accommodate the pegs and posts. The extensive handling adds potential for spreading of germs to the components as well.

With another known dishwasher basket, separators are included. However, they do not attempt to control or align the components relative to one another.

With another known dishwasher basket, only the ring and cap (not the nipple) are aligned with each other, and they are not pushed together. This basket further includes a pin between the ring and cap, but the pin blocks easy and quick reassembly of the cap and ring with each other. And, even when the cap and ring are held in position relative to the basket and/or each other, the cap and ring are not stacked with each other. Consequently, this basket requires more space for the basket to accommodate the cap and ring.

With another known dishwasher basket, the nipples are held in a top half of the basket. In this basket, the rings and caps are located below the nipples in a compartment disposed in a lower half of the basket. In this basket, the rings and caps can form a relatively dense lattice-barrier between the nipples and cleaning and rinsing system of the dishwasher. As such, the rings and caps and other items located in the "lower half" compartment block or significantly reduce circulation of cleaning and rinsing fluids of the dishwasher to the nipples, thereby limiting cleaning and rinsing of the nipples by the dishwasher.

With another known dishwasher basket, features of the basket defining corresponding positions of the respective components retain them too closely together, thereby limiting a number of components, especially the nipples, of a larger size that can fit into the basket. More specifically, spacing between adjacent components is too small, preventing optimal use of the basket. To illustrate, the basket can define slots or be designed for, say, ten or more small nipples, but only five nipples can physically be held in the basket.

With another known dishwasher basket, a user of the basket often dumps the components into a storage area, such as a drawer, for reassembly thereof with each other on an "as needed" basis. However, this exposes the components to repeated contact with hands and residue in the storage area.

With another known dishwasher basket, a top thereof is relatively thin and heavy. Accordingly, when the basket is opened, the basket falls over, which makes loading thereof difficult. In addition, nipples disposed on the top of the basket can hit, say, a counter and get dirty after completion of a washing. Moreover, the top and a bottom of the basket can define different respective heights thereof such that the top and bottom are not stable when they are opened.

With another known dishwasher basket, a relatively large "footprint" breadth thereof is defined across which a lattice structure is defined. Moreover, within the basket, the components pack against the lattice. The structure and its application make it difficult to fit the basket over posts located inside the rack of the dishwasher.

With another known dishwasher basket, there is no pusher or puller included therewith. For this reason, the nipple must be manually pushed or pulled onto the corresponding ring in an area directly in contact with baby formula or a mouth of a baby.

With another known dishwasher basket, the basket cannot be stacked with another basket due to design thereof. More specifically, the basket may have the components protruding out of a top thereof, and/or the basket may have physical features preventing the stacking. As such, a user who must have multiple baskets to meet his/her needs requires greater countertop space to store the baskets while the components dry, which is often done prior to storing the components.

With another known dishwasher basket, the components are randomly and/or loosely held with respect to the basket such that the basket does not allow water to shed off the components. In this way, the basket does not allow for optimal drying of the components on the basket. As a result, a separate drying rack may be required for drying of the components.

Thus, there is a need in the related art for a basket of a dishwasher for washing the components. More specifically, there is a need in the related art for such a basket that holds the components in position relative to the basket and/or each other. There is a need in the related art for such a basket also with which the nipples do not protrude from or stick out of the top of the basket. There is a need in the related art for such a basket with which also the components are all aligned with each other. There is a need in the related art for such a basket with which also the rings and caps cannot form a relatively dense lattice-barrier between the nipples and cleaning and rinsing system of the dishwasher. There is a need in the related art for such a basket with which also easy and quick reassembly of the components with each other is not prevented. There is a need in the related art for such a basket with which also positions of the respective components are not retained too closely together. There is a need in the related art for such a basket with which also the user thereof does not dump the components into a storage area for reassembly of the components with each other. There is a need in the related art for such a basket also the top of which is not relatively thin and heavy, with which nipples disposed on the top cannot hit a counter and get dirty after completion of a washing, and the top and bottom of the basket are stable when they are opened. There is a need in the related art for such a basket that also does not define a relatively large "footprint" breadth thereof across which a lattice structure is defined. There is a need in the related art for such a basket that also includes a pusher or puller. There is a need in the related art for such a basket with which also a plurality of the basket can be stacked with each other. There is a need in the related art for such a basket with which also the components are not highly exposed to contaminants, dirt, and germs. There is a need in the related art for such a basket also with respect to which the components are not randomly and/or loosely held such that the basket allows water to shed off the components and, in turn, the basket allows for optimal drying of the components on the basket. There is a need in the related art for such a basket that also may not require a separate drying rack for drying of the components.

SUMMARY OF INVENTION

The invention overcomes the disadvantages in the known dishwasher baskets in a basket of a dishwasher for washing a cap, ring, and nipple (collectively, "the components") of a baby bottle. The basket comprises a body for holding the ring and nipple in position in substantially non-contacting relationship with each other and relative to the dishwasher and including at least one restraint that extends from at least one interior side wall of the body into an interior of the body and retains the ring above a part of the nipple while allowing a remainder of the nipple to pass by the ring. A cover is disposed substantially directly above and spaced from the body for holding the cap in position relative to the ring, nipple, and dishwasher and covering an entirety of the components and a remainder of the basket. At least one grid is disposed between the body and cover for spacing the nipple and ring from the cap and movable out of the way such that a substantially vertical path defined by alignment of the components with each other is substantially clear for reassembly of the components with each other.

An advantage of the dishwasher basket according to the invention is that it holds the components in position relative to the basket and/or each other.

Another advantage of the dishwasher basket according to the invention is that the nipple does not protrude from or stick out of a top of the basket.

Another advantage of the dishwasher basket according to the invention is that it aligns the components with each other.

Another advantage of the dishwasher basket according to the invention is that the ring, cap, and other items in the basket cannot form a relatively dense lattice-barrier between the nipple and cleaning and rinsing system of the dishwasher.

Another advantage of the dishwasher basket according to the invention is that it does not prevent easy and quick reassembly of the components with each other.

Another advantage of the dishwasher basket according to the invention is that it does not retain positions of the respective components too closely together.

Another advantage of the dishwasher basket according to the invention is that a user thereof does not dump the components into a storage or counter area for reassembly of the components with each other.

Another advantage of the dishwasher basket according to the invention is that the top thereof is not relatively thin and heavy, a nipple disposed on the top of the basket cannot hit a counter and get dirty after completion of a washing, and the top and a bottom of the basket are stable when they are opened.

Another advantage of the dishwasher basket according to the invention is that it does not define a relatively large "footprint" breadth thereof across which a lattice structure is defined.

Another advantage of the dishwasher basket according to the invention is that it includes a pusher (puller) disposed on the basket.

Another advantage of the dishwasher basket according to the invention is that it can be stacked with a plurality of the basket.

Another advantage of the dishwasher basket according to the invention is that it does not highly expose the components to contaminants, dirt, and germs.

Another advantage of the dishwasher basket according to the invention is that the components are not randomly and/or loosely held with respect to the basket such that the basket allows water to shed off the components and, in turn, the basket allows for optimal drying of the components on the basket.

Another advantage of the dishwasher basket according to the invention is that it may not require a separate drying rack for drying of the components.

Those having ordinary skill in the related art should readily appreciate objects, features, and other advantages of the basket of a dishwasher for washing components of a baby bottle according to the invention as it becomes more understood while the subsequent detailed description of embodiments of the dishwasher basket is read taken in conjunction with an accompanying drawing thereof.

BRIEF DESCRIPTION OF EACH FIGURE OF DRAWING OF INVENTION

DETAILED DESCRIPTION OF EMBODIMENTS OF INVENTION

Figure 5:
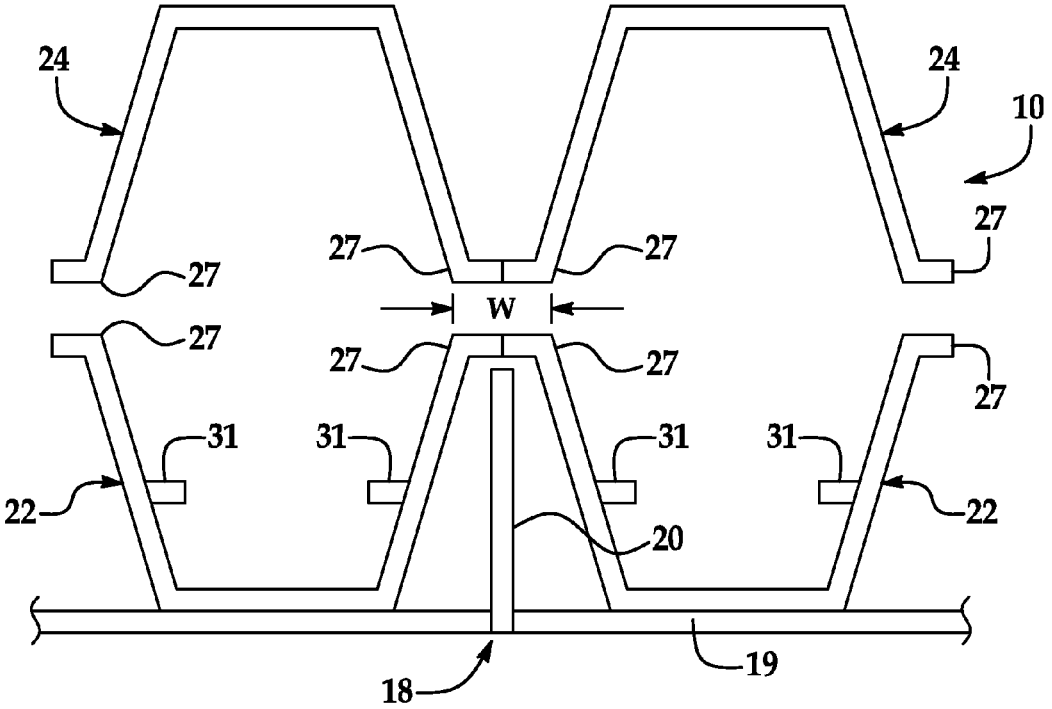
FIG. 5 is a view showing an embodiment of the dishwasher basket according to the invention having a plurality of rows.

Referring now to the figures, throughout which like reference numerals are used to designate like structure, a basket of a dishwasher for washing certain components of a baby bottle according to the invention is generally indicated at 10. As described below and shown in the figures, the baby bottle (not shown in its "assembled" state) includes generally, among other structure, a cap, generally indicated at 12, a ring, generally indicated at 14, and a nipple, generally indicated at 16 (hereinafter referred to collectively as "the components 12, 14, 16"). The dishwasher, generally indicated at 18, includes generally, among other structure, at least one basket 10 and, as shown in FIG. 5, at least one rack 19 and post 20.

It should be readily appreciated by those having ordinary skill in the related art that each of the components 12, 14, 16 can have any suitable shape, size, and structure and structural relationship with each other, the basket 10, and a remainder of the dishwasher 18. It should be so appreciated also that such bottles can differ relative to each other with respect to shape, size, and structure. It should be so appreciated also that the basket 10 can be used with components of the bottle other than the components 12, 14, 16. It should be so appreciated also that the dishwasher 18 can have any suitable shape, size, and structure and the basket 10 can have any suitable structural relationship with the remainder of the dishwasher 18. It should be so appreciated also that the basket 10 can be employed with any suitable dishwasher. It should be so appreciated also that, in turn, the basket 10 can be used with any suitable bottle such that use of the basket 10 is not limited to baby bottles. It should be so appreciated also that the dishwasher 18 can wash the components 12, 14, 16 in any suitable manner. It should be so appreciated also that the components 12, 14, 16 and dishwasher 18 (other than the basket 10 of the dishwasher 18) and water used in the washing of the components 12, 14, 16 play no part of the invention.

Referring back to the figures, the basket 10 comprises, in general, a body, generally indicated at 22, configured to hold the ring 14 and nipple 16 in position in substantially non-contacting relationship with each other and relative to the dishwasher 18. A cover, generally indicated at 24, is disposed substantially directly above and spaced from the body 22 and configured to hold the cap 12 in position relative to the ring 14, nipple 16, and dishwasher 18 and cover the cap 12, ring 14, and nipple 16 and a remainder of the basket 10. At least one grid, generally indicated at 26, is disposed between the body 22 and cover 24 and configured to space the nipple 16 and ring 14 from the cap 12. Water from the dishwasher 18 can contact substantially all surface area of each of the components 12, 14, 16 without the water collecting within the component 12, 14, 16. The components 12, 14, 16 are substantially aligned with each other such that they can be easily and quickly reassembled with each other.

Figure 1:
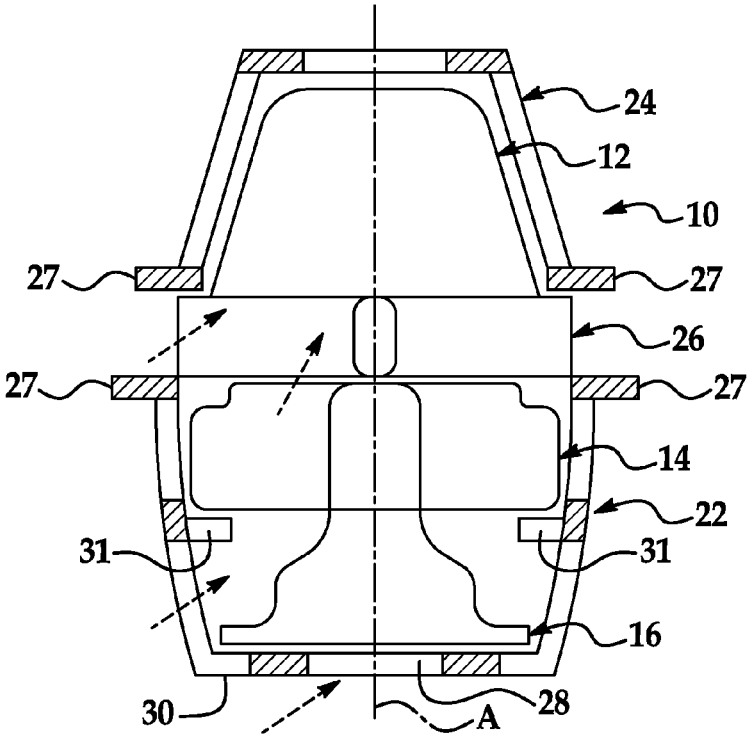
FIG. 1 is a view showing an embodiment of a basket of a dishwasher for washing a baby bottle according to the invention employed with the dishwasher and used with particular components of the bottle.
Figure 10:
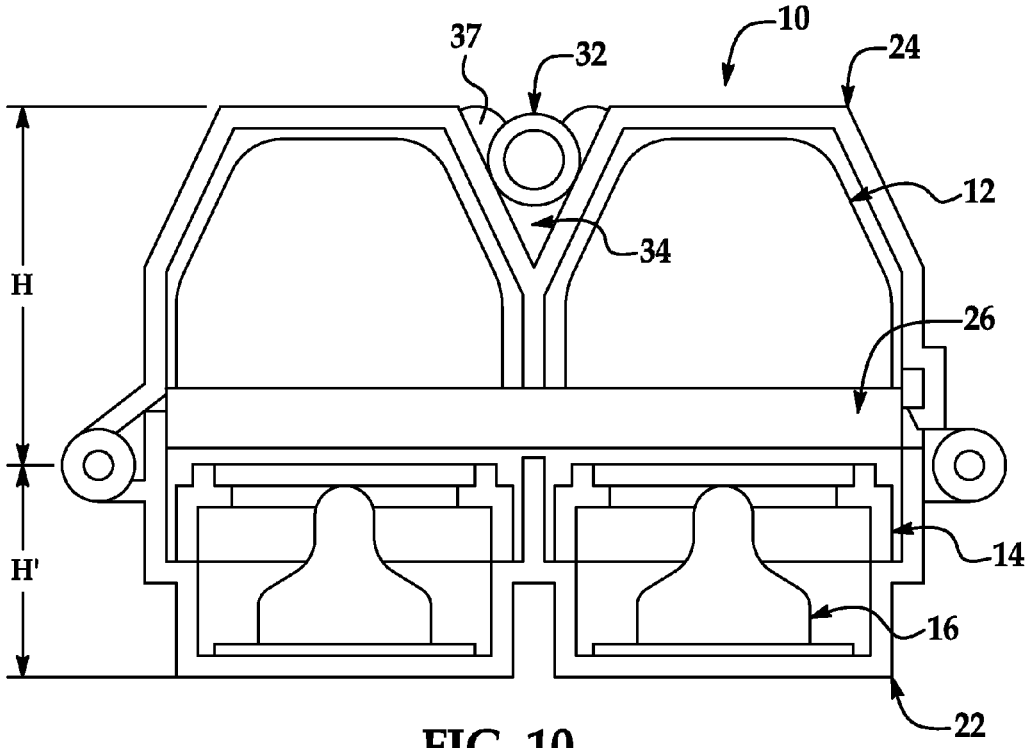
FIG. 10 is an end view showing an embodiment of the dishwasher basket according to the invention.

In particular and referring now to FIGS. 1 and 10, an embodiment of the basket 10 is shown. As shown in FIG. 1, the components 12, 14, 16 are held in line with, but separated from, one another such that the water can flow around each of the components 12, 14, 16 during the washing without their losing their orientation. As can easily be seen, the basket 10 defines a substantially central vertical axis "A" of the basket 10. (In the description that follows, "height" refers to distance along or in a direction of the axis "A," "width" refers to distance along an imaginary line that is normal to the axis "A" in the two-dimensional plane defined by the figure, and "length" refers to distance along another imaginary line that is normal to both the axis "A" and plane defined by the figure.) The components 12, 14, 16 are ordered along the axis "A" with the cap 12 being located at a top portion, the ring 14 being located in a middle portion, and the nipple 16 being located at a bottom portion of the axis "A" such that the components 12, 14, 16 are disposed substantially co-axial with respect to each other and symmetrical with respect to each other and the basket 10.

There is minimal (if any) contact of each of the components 12, 14, 16 with either of the other two components 12, 14, 16 or any part of the dishwasher 18, including the basket 10. In this way, space is defined (to varying amounts and in varying planes) between the cap 12 and ring 14, the cap 12 and nipple 16, the ring 14 and nipple 16, the cap 12 and cover 24, the ring 14 and body 22, the nipple 16 and body 22, the body 22 and cover 24, the body 22 and grid 26, and the cover 24 and grid 26. The spaces are configured to be sprayed or filled with the water during the washing of the components 12, 14, 16. The grid 26 defines a substantially rectangular cross-section of the grid 26 (from the perspective of the plane defined by the figure). Each of the body 22 and cover 24 defines a substantially U-shaped cross-section of the body 22/cover 24 (from the same perspective), and the body 22 and cover 24 are substantial (but not necessarily identical) "mirror" images of each other.

More specifically and in the embodiment shown in FIG. 1, the respective opposing closed ends of the body 22 and cover 24 are substantially linear and parallel with each other, and the two opposing sides (legs) of each of the body 22 and cover 24 are substantially linear and taper toward the corresponding closed end of the body 22/cover 24. The closed end of each of the body 22 and cover 24 defines a width of the closed end that is substantially identical to a height defined by each of the sides of the body 22/cover 24. Each of the sides of each of the body 22 and cover 24 terminates (at the open end of the body 22/cover 24) with a shelf 27 that is substantially linear, extends away from the axis "A," and is substantially parallel with the corresponding closed end of the body 22/cover 24. The shelves 27 are substantially uniform with respect to each other and extend any suitable length of the body 22/cover 24. If the grid 26 were absent and the body 22 and cover 24 were to come into contacting relationship with each other, the shelf 27 of the body 22 would be disposed substantially flush with the shelf 27 of the cover 24. Each of the shelves 27 extends farther away from the axis "A" than the grid 26 extends away from the axis "A" and defines a width of the shelf 27 that is substantially smaller than the width of each of the closed end and sides of each of the body 22 and cover 24. The width of the shelf 27 can be greater or lesser than the amount of the taper of the leg away from the corresponding closed end of the body 22/cover 24. The width of the grid 26 is substantially equal to the greatest width of each of the body 22 and cover 24 (absent the respective shelves 27). The height of the grid 26 is substantially smaller than the height of each of the body 22 and cover 24. The amount of space defined between the respective open ends of the body 22 and cover 24 is dependent upon the thickness of the grid 26. The corners of each of the body 22 and cover 24 can be substantially linear or arcuate.

The outside of each of the components 12, 14, 16 is held in such a way to permit the reassembly after the washing. Restraints 31 provide frictional and structural contact between the components 12, 14, 16 and basket 10 for restraining respective positions of the components 12, 14, 16 during the washing. In an embodiment, the restraints 31 are a set of tabs 31 arranged in a substantial circle that extend into an interior of the body 22 from interior side walls of the body 22. The tabs 31 are located substantially halfway down the body 22 and are substantially parallel with and of substantially equal height and width as the shelves 27. The tabs 31 ensure retention of the ring 14 above a part of the nipple 16 while allowing a remainder of the nipple 16 to easily pass by the ring 14 with little or no effort. Alternatively, the tabs 31 allow the nipple 16 to easily pass by the tabs 31 with little or no effort and ensure retention of the ring 14 above a part of the nipple 16. The tabs 31 define an inner diameter of the tabs 31, and relatively substantial space is defined between the inner diameter and the nipple 16. The components 12, 14, 16 are held such that the water does not settle in them during the washing. In another embodiment, each of the components 12, 14, 16 is held with a peg (not shown) located within a center of the component 12, 14, 16 to hold its alignment. To this end, the nipple 16 is placed in the body 22 due to position of the nipple 16 relative to the ring 14 and cap 12 for the reassembly. The relative positions of the respective components 12, 14, 16 allow for optimum flow of detergent and the water among the components 12, 14, 16 to ensure that the dishwasher 18 cleans and rinses the components 12, 14, 16 sufficiently.

In short, during the washing and drying of the components 12, 14, 16 by the dishwasher 18, the grid 26 holds down the ring 14 and nipple 16 and holds up the cap 12. More specifically, the grid 26 separates the cap 12 from the ring 14 and nipple 16, keeps the ring 14 and nipple 16 from rising into interior space of the cap 12 (where the ring 14 and nipple 16 would reduce or block the flow of the water during the washing), and holds the cap 12 up in the cover 24 so that the cap 12 does not reduce or block the flow of the water to the ring 14 and nipple 16. During the reassembly, the grid 26 is moved out of the way. As a result, a path defined between the cap 12 and the ring 14 and nipple 16 is substantially clear for the reassembly.

In an embodiment, the grid 26 can define contact-surface areas (not shown) of the grid 26 that make contact with corresponding nipples 16 to retain them in their respective positions. By way of example only, the contact-surface areas can define a "simple bar" design, flat "square pad" design, "cone-like" design, and circular, flat "ring" design. The "simple bar" design requires a smaller space, thereby allowing water easier access to inner surfaces of the cap during washing. The "square pad," "cone-like," and "ring" designs, respectively, better retain the nipples 16 in their respective positions.

Referring now back to FIG. 1, at least one hole 28 is defined in a bottom side 30 (the closed end) of the body 22 and configured to receive a pusher or puller, generally indicated at 32 (hereinafter referred to as merely "the pusher" 32). The pusher 32 can be matingly inserted through the hole 28 and into the basket 10 for pushing the components 12, 14, 16 together and stacking the components 12, 14, 16 with each other such that the components 12, 14, 16 can be easily and quickly reassembled with each other. The hole 28 is substantially centered on the nipple 16 to allow use of most flatware to push the components 12, 14, 16 past any of the restraints 31. Direction of the push is from exterior the basket 10 toward interior the basket 10. In an embodiment, a larger hole 28 can maximize the flow of the water (including cleaning agents) to the nipple 16. In another embodiment, the body 22 may not define the "center" hole 28. Rather, the body 22 can define side holes 28 sufficiently large to push the components 12, 14, 16 through an interior of the basket 10 for the reassembly. In this embodiment, the basket 10 can be configured to be flipped over prior to pushing of the nipple 16 past the restraints 31.

As shown in FIG. 10, the components 12, 14, 16 are held in their respective positions to allow the easy reassembly to each other after the washing of the components 12, 14, 16. Also, spacing among the components 12, 14, 16 and corresponding parts of the dishwasher 18 is maintained to allow for better circulation of the water within the dishwasher 18 and, thus, cleaning and rinsing of the components 12, 14, 16. Furthermore, the pusher 32 is held on top of the basket 10 to allow simultaneous cleaning and rinsing of the pusher 32 with the cleaning and rinsing of the components 12, 14, 16 and keep the pusher 32 available for use of the pusher 32 in the reassembly of the components 12, 14, 16 to each other. In addition, in an embodiment, an "egg crate" grid 26 can hold the nipple 16 from rising (into the region of the cover 24) during the washing of the components 12, 14, 16. Moreover, as shown in FIG. 10, a height "H" of the cover 24 is substantially equal to a height "H'" of the body 22 for stable "counter" and "loading" positions.

It should be readily appreciated by those having ordinary skill in the related art that the restraints 31 can be any suitable structure for restraining the components 12, 14, 16 in their respective positions. It should be so appreciated also that the restraints 31 can have any suitable shape, size, and structure and structural relationship with each other and the components 12, 14, 16 and remainder of the basket 10. It should be so appreciated also that the basket 10 can include any suitable number and type of restraints 31. It should be so appreciated also that the hole 28 can be defined at any suitable location of the basket 10. It should be so appreciated also that the components 12, 14, 16 can be held in any suitable manner and position. It should be so appreciated also that the grid 26 can hold down the ring 14 and nipple 16 and hold up the cap 12, separate the cap 12 from the ring 14 and nipple 16, keep the nipple 16 and ring 14 from rising into the interior of the cap 12, hold the cap 12 up in the cover 24, and be moved out of the way in any suitable manner. It should be so appreciated also that the basket 10 can include any suitable number of grids 26. It should be so appreciated also that each of the contact-surface areas of the grid 26 can have any suitable shape, size, and structure and structural relationship with the corresponding nipple 16 and a remainder of the grid 26 and make contact with the corresponding nipple 16 in any suitable manner to retain the nipple 16 in its respective position. It should be so appreciated also that the hole 28 can have any suitable shape and size and relationship with a remainder of the body 22 and, thus, the nipple 16. It should be so appreciated also that the basket 10 can include any suitable number of holes 28. It should be so appreciated also that each of the cover 24 and body 22 can define any suitable height "H," "H'," respectively. It should be so appreciated also that each of the body 22, cover 24, and grid 26 can be made of any suitable material and by any suitable method.

Figure 2:
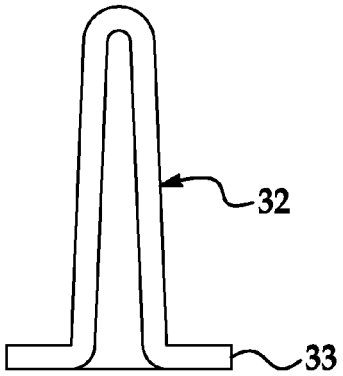
FIG. 2 is a view showing an embodiment of a pusher (puller) of an embodiment of the dishwasher basket according to the invention.

Referring now to FIG. 2, the pusher 32 forces the components 12, 14, 16 past the restraints 31 after the washing and aids in the reassembly. Use of the pusher 32 minimizes transmission of dirt to the components 12, 14, 16 during the reassembly. The pusher 32 can define various forms (including radii) of the pusher 32 to minimize risk of puncturing or damaging the components 12, 14, 16. For example, in the embodiment of FIG. 2, the pusher 32 defines a substantially tubular longitudinal cross-section and arcuate corners of the pusher 32. The pusher 32 tapers slightly from the open end of the pusher 32 to the closed end of the pusher 32. The pusher 32 defines a flange 33 disposed about the open end of the pusher 32, and a user of the pusher 32 can handle the flange 33 for him/her to manually insert the pusher 32 into/extract the pusher 32 from the basket 10. In another embodiment, the closed end of the pusher 32 can be wider, and the corners of the pusher 32 can be more linear vis-à-vis the closed end and corners of the embodiment of the pusher 32 shown in FIG. 2. Alternatively, the pusher 32 defines a substantially extruded cross and a substantially spherical end of the pusher 32, and a user of the pusher 32 can push/pull the end for him/her to manually insert the pusher 32 into/extract the pusher 32 from the basket 10.

It should be readily appreciated by those having ordinary skill in the related art that the pusher 32 can have any suitable shape, size, and structure and structural relationship with the components 12, 14, 16 and remainder of the basket 10. It should be so appreciated also that the pusher 32 can define any suitable form (including radii) of the pusher 32.

Figure 3:
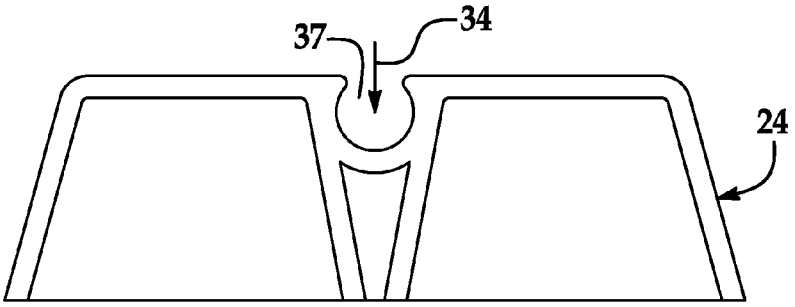
FIG. 3 is an end or side view of an embodiment of the dishwasher basket according to the invention showing an embodiment of a storage area thereof for the pusher (puller) illustrated in FIG. 2.

Referring now to FIG. 3, the basket 10 provides a "mounting" position for the pusher 32 in the form of a storage area, generally indicated at 34. In this way, the "washing" cycle cleans the pusher 32 with the components 12, 14, 16 to ensure maximum cleanliness of the pusher 32 and, in turn, components 12, 14, 16. In each of the respective embodiments of the storage area 34 shown in these figures, the storage area 34 is dimensioned such that the storage area 34 is configured to matingly receive the pusher 32. As shown in FIG. 3, an opening 37 of/into the storage area 34 is defined.

It should be readily appreciated by those having ordinary skill in the related art that each of the storage areas 34 can have any suitable shape, size, and structure and structural relationship with the pusher 32 and remainder of the basket 10. It should be so appreciated also that the pusher 32 can be cleaned and rinsed in any suitable manner. It should be so appreciated also that the opening 37 can have any suitable shape, size, and structure and structural relationship with the corresponding storage area 34, pusher 32, and remainder of the basket 10.

Figure 4:
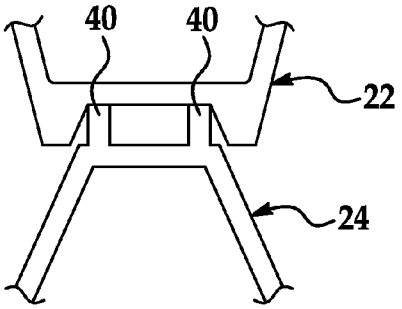
FIG. 4 is a view showing the body and cover of an embodiment of the dishwasher basket according to the invention stacked with respect to each other.

In an embodiment, the cover 24 is hingedly connected to the body 22, and, as shown in FIG. 4, a closed end of each of the cover 24 and body 22 includes at least one of feature 40 (FIG. 4). In an embodiment, the feature 40 includes a pair of opposed legs 40. In a "covering" state of the cover 24, a distance from a free end of the legs 40 of the cover 24 to a free end of the legs 40 of the body 22 can define a height of the basket 10. In this state, the components 12, 14, 16, body 22, and cover 24 can be cleaned and rinsed. When the cover 24 is moved to an "uncovering" state of the cover 24, the basket 10 can be essentially split in half. The height of the cover 24 can be substantially equal to the height of the body 22. As a consequence, the basket 10 may not fall over during loading and unloading of the basket 10, and it can be easier to load and unload the basket 10.

The legs 40, regardless of shape and form, act as "standoffs" that lessen a likelihood that dirt and fluids from a counter (upon which the basket 10 rests) contaminate the components 12, 14, 16 during the reassembly and unloading. As such, the legs 40 aid in keeping the components 12, 14, 16 clean by separating and isolating the components 12, 14, 16 from the counter and likely contaminants thereon.

The legs 40 allow the body 22 to nest with the cover 24 or vice versa and, thus, permit stacking of the body 22 and cover 24 with respect to each other. In this way, the basket 10 takes up less surface area of the counter or a shelf while the components 12, 14, 16 air-dry or when the basket 10 is stored. In an embodiment, the components 12, 14, 16 dry prior to the reassembly. The components 12, 14, 16 being dry minimizes risk of contamination and growth of mold.

In another embodiment, the feature 40 on the cover 24 is a ring (not shown) that can fit into the hole 28 defined in the bottom of the body 22. The feature 40 on the body 22 is a ring that can be disposed around the hole 28 like the cover 24 and configured to act as a "standoff" to the counter, finish height from the counter to pivot, and act as a "stacking" feature. Alternatively, the ring can extend from the bottom of the basket 10 and be inserted into the cover 24 during the stacking, and the hole 28 can be defined on top of the cover 24. The ring being disposed on the bottom of the basket 10 can act as a "standoff" for the nipples 16. In contrast, the ring being disposed on top of the basket 10 can hold the top of the cap 12 away from the counter (which is less of a hygiene-related issue).

It should be readily appreciated by those having ordinary skill in the related art that the cover 24 can be connected to the body 22 in any suitable manner. It should be so appreciated also that the feature(s) 40 can have any suitable shape, size, and structure and structural relationship with each other and the remainder of the basket 10. It should be so appreciated also that the basket 10 can include any suitable number and type of feature(s) 40. It should be so appreciated also that the basket 10 can define any suitable height in the "covering" state of the cover 24. It should be so appreciated also that the body 22 can nest with the cover 24 in any suitable manner. It should be so appreciated also that the components 12, 14, 16 dry at any suitable time. It should be so appreciated also that the height of the cover 24 and body 22 can differ by any suitable distance.

Referring to FIG. 5, when the basket 10 defines a plurality of rows for the components 12, 14, 16, the rows are sufficiently spaced from each other to allow the basket 10 to be easily fitted into the dishwasher 18. In the embodiment shown in this figure, there are two such rows. As can be easily seen, a width "W" of a combination of adjacent corresponding shelves 27 is greater than a diameter of the post 20 of the dishwasher 18.

It should be readily appreciated by those having ordinary skill in the related art that the basket 10 can define any suitable number of rows. It should be so appreciated also that the width "W" can be any suitable width.

Figure 6:
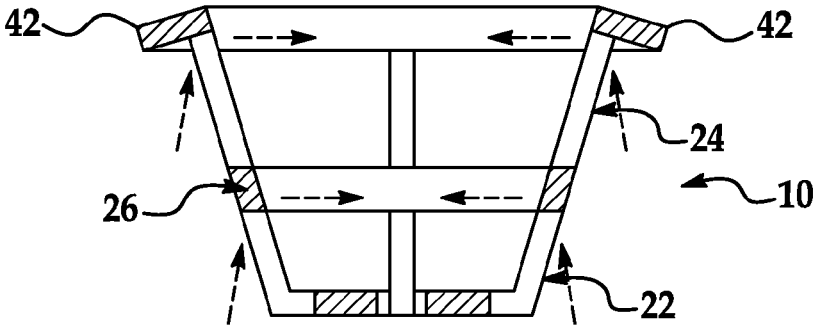
FIG. 6 is a view showing surfaces and features of an embodiment of the dishwasher basket according to the invention that direct and deflect water into the dishwasher basket and toward the components.

Referring now to FIG. 6, at least one appendage or angling surface 42 of the basket 10 directs and deflects water into the basket 10 and toward the components 12, 14, 16 to maximize effectiveness of the washing. More specifically, the angling surface 42 is positioned in a path of the flow of the water, which directs the water into (rather than away from) the components 12, 14, 16 when the basket 10 is sprayed from beneath the basket 10. In an embodiment, the angling surface 42 is a set of tabs 42.

It should be readily appreciated by those having ordinary skill in the related art that the angling surface 42 can have any suitable position on the basket 10. It should be so appreciated also that the basket 10 can include any suitable number and type of angling surface(s) 42.

Features of the basket 10 of geometric shape (such as circular, square, hexagonal, octagonal, etc.) can hold respective "circular" features of the bottle. In respective embodiments, the features can be square, hexagonal, octagonal, and circular. Also, in comparison to the baskets of the related art, spacing of each embodiment can allow for easier loading of the dishwasher 18, and alternating features can direct the water into the components 12, 14, 16 better. Those having ordinary skill in the related art should readily appreciate that such respective features of the basket 10 and bottle can have any suitable shape.

The basket 10 can hold any suitable number of sets of the components 12, 14, 16 in any suitable array of configurations-e.g., 1×1, 2×1, 3×1, etc. . . . 1×2, 2×2, 3×2, etc. . . . 2×1, 2×2, etc. . . . 3×1, 3×2, etc. An embodiment of the basket 10 can be of a "six-cap assembly" style ("2×3" array). Of course, the basket 10 can be a style defining any of various suitable arrays (e.g., 1×1, 2×1, 3×1, 2×2, 2×4, 3×3, 2×3, etc.).

Figure 7:
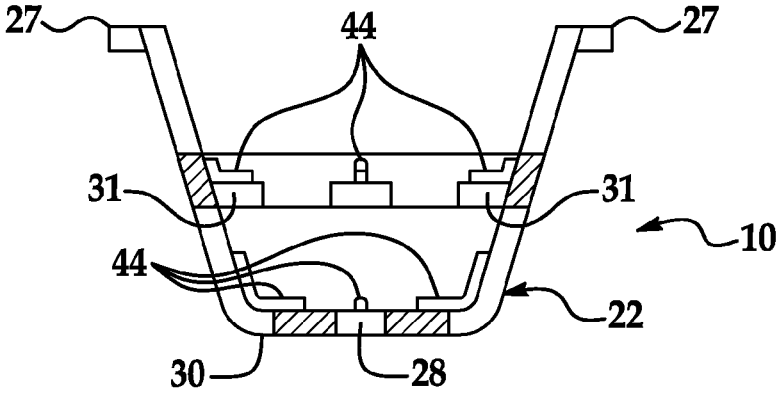
FIG. 7 is a view showing "standoffs," ribs, and spikes of a bottom of an embodiment of the dishwasher basket according to the invention.

Referring now to FIG. 7, the basket 10 defines "standoffs" and ribs 44 of the basket 10 that minimize corresponding areas of contact between the components 12, 14, 16 and basket 10, which, in turn, reduces retained water due to capillary action or the like (retained water slows drying of the components 12, 14, 16). Use of a particular shape of a bottom of the basket 10 reduces water retention among the components 12, 14, 16 and promotes drying. Angling of side ribs 44 minimizes stagnant water retention. In an embodiment, a "drying" technique includes bottom and side ribs 44 running on two planes to reduce "water bridging." In an embodiment, as drying features, spikes and/or ribs 44 are disposed on the bottom of the basket 10. After the washing, the components 12, 14, 16 sit on the ribs 44 to reduce water retention.

It should be readily appreciated by those having ordinary skill in the related art that the "standoffs," ribs, and spikes 44 can have any suitable shape, size, and structure and structural relationship with each other and the components 12, 14, 16 and remainder of the basket 10. It should be so appreciated also that the basket 10 can include any suitable number and type of "standoffs," ribs, and spikes 44.

Figure 9:
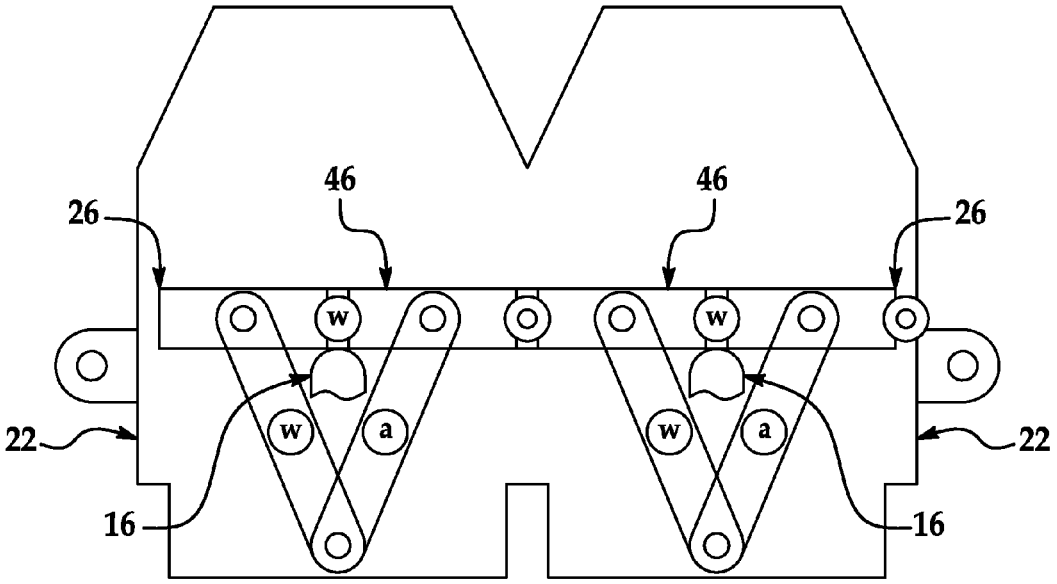
FIG. 9 is a view showing an embodiment of the dishwasher basket according to the invention using an embodiment of a four-bar linkage with which a method for using the dishwasher basket can be employed.

Referring now to FIG. 9, a mechanism, generally indicated at 46, moves the grid 26 out of the way for the reassembly. By way of example only and not by way of limitation, the mechanism 46 can include any of a four-bar linkage 46, a simple loose rack (not shown), dual-hinged simple bars (not shown), a full-hinged grate (not shown), a rotary (not shown), and a guillotine (not shown). The dual-hinged simple bars can be closed and opened. The hinged grate can be closed and in place, opened and moved out of the way, and closed and moved out of the way. FIG. 9 shows an embodiment of the basket 10 using the four-bar linkage 46 with which a method can be employed. More specifically, steps of the method include using the four-bar linkage 46 to shuttle a separator from a "wash" position ("w") to an "assemble" position ("a"), simply removing the "egg crate" grid 26, sliding into the "wash" position ("w") and over to the "assemble" position ("a"), and flipping the "egg crate" grid 26 out to a side for the reassembly after the washing.

It should be readily appreciated by those having ordinary skill in the related art that the mechanism 46 can have any suitable shape, size, and structure and structural relationship with the grid 26 and remainder of the basket 10. It should be so appreciated also that the mechanism 46 can be closed, opened, remained in place, and moved out of the way in any suitable fashion. It should be so appreciated also that any suitable method can be employed with any of the mechanisms 46 for moving the grid 26 out of the way for the reassembly.

Figure 8A:
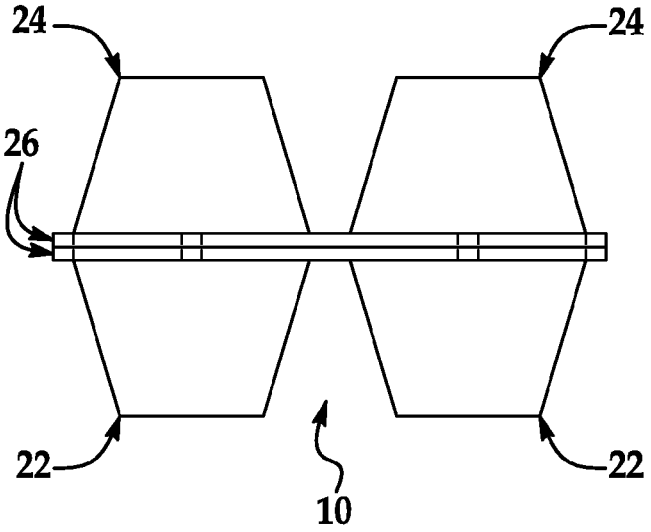
FIGS. 8A and 8B are respective views showing a "'dual grid" design of an embodiment of the dishwasher basket according to the invention.
Figure 8B:
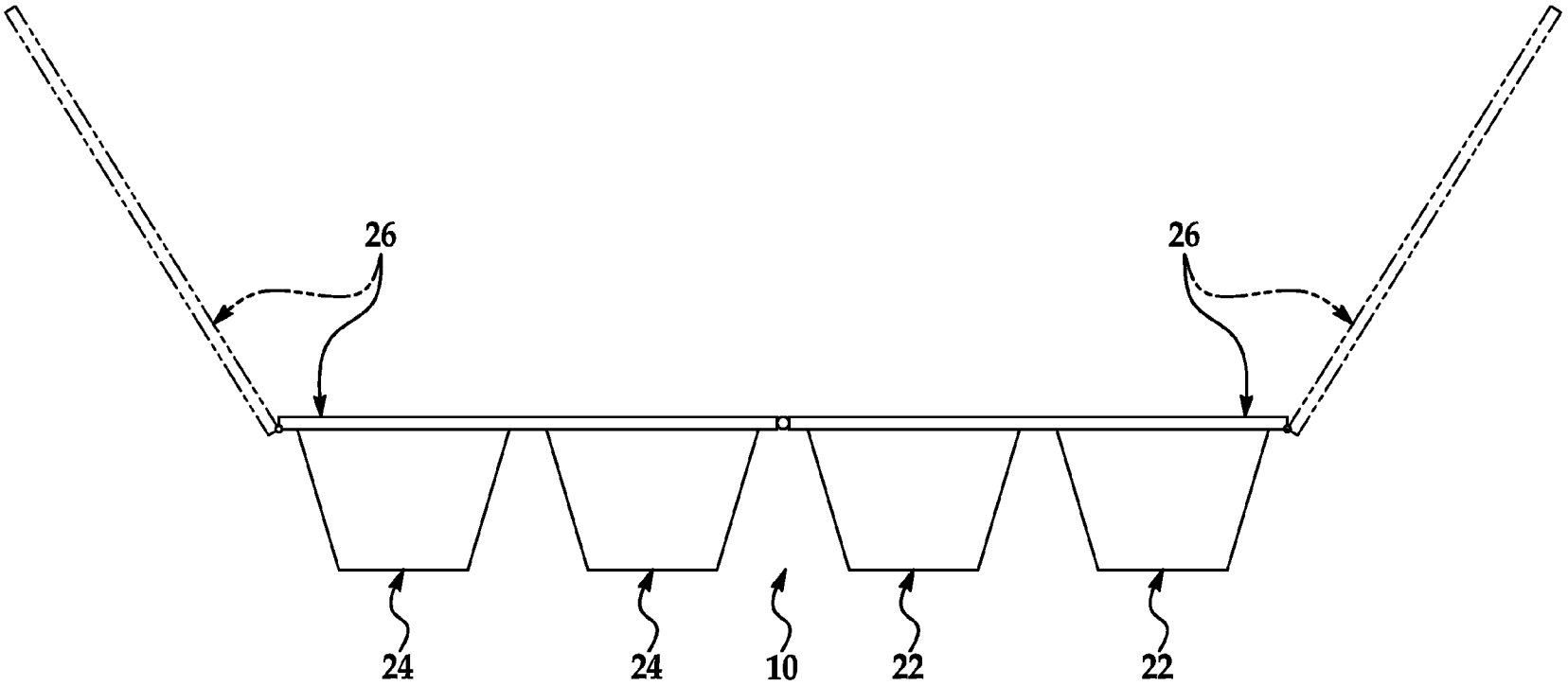

Referring now to FIGS. 8A and 8B, the basket 10 can include a plurality of grids 26. In an embodiment, the basket 10 includes two grids 26 ("dual grid" design). Other than separating the components 12, 14, 16 from each other, the grid 26 provides room for an increase in the flow of the water (due to a corresponding larger size of the basket 10) and holds down the nipple 16. The figure shows the basket 10 closed (FIG. 8A) and going from "opened" to "closed" or vice versa (FIG. 8B). In another embodiment, the "egg crate" grid 26 can define substantially square corners of the "egg crate" grid 26, and substantially round pads (not shown) can direct the water toward the respective nipples 16 and hold the nipples 16 better as compared to the baskets of the related art.

It should be readily appreciated by those having ordinary skill in the related art that the basket 10 can include any suitable number of grids 26. It should be so appreciated also that the grid(s) 26 can be closed and opened in any suitable fashion. It should be so appreciated also that the corners of the "egg crate" grid 26 can define any suitable shape. It should be so appreciated also that each of the pads can define any suitable shape, size, and structure and structural relationship with each of the other pads and the grid 26, respective nipples 16, and remainder of the basket 10. It should be so appreciated also that the pads can direct the water toward the respective nipples 16 and hold the nipples 16 in any suitable manner. It should be so appreciated also that the basket 10 can include any suitable number of pads.

An embodiment of the basket 10 can define "circular" retaining features (not shown). This embodiment may not include the storage area 34 for holding the pusher 32 and may or may not require any slides to be molded. However, those having ordinary skill in the related art should readily appreciate that the retaining features 48 can be of any suitable shape and can include the storage area 34 for holding the pusher 32.

In operation of the basket 10, the basket 10 holds the components 12, 14, 16 in such a way that the water does not collect in the components 12, 14, 16, the components 12, 14, 16 can be easily reassembled with each other after the washing, and the water and cleaning solutions can flow around the components 12, 14, 16 freely. Balanced (or relatively balanced) height of the basket 10 allows a stable "standing" posture of the basket 10 for use and loading of the basket 10. The design of the removable grid 26 holds the components 12, 14, 16 in position relative to one another—i.e., apart from each other (the ring 14 and nipple 16 down and the cap 12 up)—during the washing and allows easy reassembly of the basket 10 when the grid 26 is moved or removed. The grid 26 can hold the components 12, 14, 16 in one half or both halves (with two grids 26) to allow easy opening of the basket 10, thus maintaining the respective positions of the components 12, 14, 16 needed for easy reassembly of the components 12, 14, 16. The hole 28, large or otherwise, located below the nipple 16 allows the pusher 32 (and most flatware or the like) to be used to push the nipple 16 into the ring 14 and cap 12. The pusher 32 is designed to not harm the nipple 16 during use of the pusher 32 and can be held to the basket 10 during the washing to ensure cleanliness of the pusher 32. The basket 10 holds the components 12, 14, 16 apart from each other for proper drying of the components 12, 14, 16. Complete dryness of the components 12, 14, 16 before reassembling of the components 12, 14, 16 promotes healthier use of the components 12, 14, 16. The basket 10 covers a top of the nipple 16 immediately without contact of the nipple 16 with hands and protects exterior surfaces of the nipple 16 during subsequent handling of the nipple 16. When the components 12, 14, 16 are placed directly onto the bottle, "exposure" protection is completed.

The basket 10 holds each of the components 12, 14, 16 in position relative to the basket 10 and/or other components 12, 14, 16. Also, the nipples 16 do not protrude from or stick out of the top of the basket 10. Furthermore, the basket 10 aligns the components 12, 14, 16 with each other. In addition, the rings 14 and caps 12 cannot form a relatively dense lattice-barrier between the nipples 16 and cleaning and rinsing system of the dishwasher 18. Moreover, the basket 10 does not prevent easy and quick reassembly of the components 12, 14, 16 with each other. Plus, the basket 10 does not retain respective positions of the components 12, 14, 16 too closely together.

The user of the basket 10 does not dump the components 12, 14, 16 into a storage area for reassembly of the components 12, 14, 16 with each other. Also, the top of the basket 10 is not relatively thin and heavy, nipples 16 disposed on the top of the basket 10 cannot hit a counter and get dirty after completion of a washing, and the top and bottom of the basket 10 are stable when they are opened. And, the basket 10 does not define a relatively large "footprint" breadth of the basket 10 across which a lattice structure is defined. Furthermore, the basket 10 includes a pusher 32 disposed on the basket 10. In addition, the basket 10 can be stacked with a plurality of the baskets 10 with the pusher 32 disposed on the basket 10. Moreover, the components 12, 14, 16 are not highly exposed to contaminants, dirt, and germs. Plus, the components 12, 14, 16 are not randomly and/or loosely held with respect to the basket 10 such that the basket 10 allows water to shed off the components 12, 14, 16 and, in turn, the basket 10 allows for optimal drying of the components 12, 14, 16 on the basket 10. The basket 10 may not require a separate drying rack for drying of the components 12, 14, 16 as well.

The basket 10 has been described above in an illustrative manner. Those having ordinary skill in the related art should readily appreciate that the terminology that has been used above is intended to be in the nature of words of description rather than of limitation. Many modifications and variations of the basket 10 are possible in light of the above teachings. Therefore, within the scope of the appended claims, the basket 10 may be practiced other than as so described.

What is claimed is:

1. A basket of a dishwasher for washing a cap, ring, and nipple (collectively, "the components") of a baby bottle, said basket comprising:

a body for holding the ring and nipple in position in substantially non-contacting relationship with each other and relative to the dishwasher and including at least one restraint that extends from at least one interior side wall of said body into an interior of said body and retains the ring above a part of the nipple while allowing a remainder of the nipple to extend within an interior space defined by the ring;

a cover disposed substantially directly above and spaced from said body for holding the cap in position relative to the ring, nipple, and dishwasher and covering an entirety of the components and a remainder of said basket; and at least one grid disposed between said body and cover for spacing the nipple and ring from the cap and movable out of the way such that a substantially vertical path defined by alignment of the components with each other is substantially clear for reassembly of the components with each other.

2. The dishwasher basket as set forth in claim 1, wherein said basket further defines a substantially central vertical axis of said basket and the components are ordered along said axis with the cap being located at a top portion, the ring being located in a middle portion, and the nipple being located at a bottom portion of said axis such that the components are disposed substantially co-axial with respect to each other and symmetrical with respect to each other and said basket.

3. The dishwasher basket as set forth in claim 2, wherein each of said body and cover defines at least one side thereof that terminates at an open end of said body and cover with a shelf that extends away from said axis.

4. The dishwasher basket as set forth in claim 1, wherein said basket further allows space between the cap and ring, the cap and nipple, the ring and nipple, the cap and said cover, the ring and said body, the nipple and said body, said body and cover, said body and grid, and said cover and grid.

5. The dishwasher basket as set forth in claim 1, wherein said basket comprises further a pusher and at least one hole defined in at least one of a bottom side and side of said body and configured to receive the pusher that can be inserted through said hole and into said basket for pushing the components together and stacking the components with each other.

6. The dishwasher basket as set forth in claim 5, wherein said pusher is configured to be held on top of said basket.

7. The dishwasher basket as set forth in claim 5, wherein said basket comprises further a storage area that is configured to store said pusher.

8. The dishwasher basket as set forth in claim 1, wherein a closed end of at least one of said cover and body includes at least one standoff that is configured to separate and isolate the components from a counter and contaminants thereon and allow said body and cover to nest with respect to each other and, thus, permit stacking of said body and cover with respect to each other.

9. The dishwasher basket as set forth in claim 1, wherein said basket defines further at least one angling surface of said basket that is positioned in a path of flow of water and configured to direct and deflect the water into said basket and toward the components.

10. The dishwasher basket as set forth in claim 1, wherein said basket defines at least one angled side rib of said basket that minimizes an area of contact between a corresponding one of the components and said basket.

11. The dishwasher basket as set forth in claim 1, wherein said basket defines at least one bottom rib or at least one side rib of said basket running on respective imaginary planes of said basket.

12. The dishwasher basket as set forth in claim 1, wherein said basket defines at least one spike and rib of said basket disposed on said bottom of said basket such that, after the washing, the components sit on said rib.

13. The dishwasher basket as set forth in claim 1, wherein said basket comprises further a mechanism for moving said grid out of the way for the reassembly.

14. The dishwasher basket as set forth in claim 13, wherein said mechanism includes a four-bar linkage.

15. The dishwasher basket as set forth in claim 1, wherein a height of said cover is substantially equal to a height of said body.

16. A basket for washing a cap, ring, and nipple (collectively, "the components") of a baby bottle, said basket comprising:

a body for holding the ring and nipple in position in substantially non-contacting relationship with each other and including at least one restraint that extends from at least one interior side wall of said body into an interior of said body and retains the ring above a part of the nipple while allowing a remainder of the nipple to extend within an interior space defined by the ring;

a cover disposed substantially directly above and spaced from said body for holding the cap in position relative to the ring, and nipple and covering an entirety of the components and a remainder of said basket; and at least one grid disposed between said body and cover for spacing the nipple and ring from the cap and movable out of the way such that a substantially vertical path defined by alignment of the components with each other is substantially clear for reassembly of the components with each other.

* * * * *